US005376914A

United States Patent [19]

Matsui et al.

[11] Patent Number: 5,376,914

[45] Date of Patent: Dec. 27, 1994

[54] ELECTROMOTIVE ADJUSTABLE RESISTOR

[75] Inventors: Hiroshi Matsui, Miyanoshita; Yoshinobu Nakagawa, Katano, both of Japan

[73] Assignee: Matsushita Electric Industrial Co., Ltd., Osaka, Japan

[21] Appl. No.: 121,417

[22] Filed: Sep. 16, 1993

[30] Foreign Application Priority Data

Sep. 22, 1992 [JP] Japan ..... 4-252474

[51] Int. Cl.[5] ..... H01C 10/14

[52] U.S. Cl. ..... 338/116; 338/DIG. 1

[58] Field of Search ..... 338/116, DIG. 1

[56] References Cited

U.S. PATENT DOCUMENTS

| | | | |
|---|---|---|---|
| 1,124,280 | 1/1915 | Brackett | 338/116 |
| 2,248,711 | 7/1941 | LeFevre | 338/116 |
| 2,575,151 | 11/1951 | Wheat | 338/116 |
| 2,863,281 | 12/1958 | Haydon et al. | 338/116 X |
| 3,100,883 | 8/1963 | Blanco | 338/116 |
| 3,547,240 | 12/1970 | Holper | 338/116 X |
| 3,900,816 | 8/1975 | Kiyono | 338/116 |
| 4,646,055 | 2/1987 | Watanabe et al. | 338/DIG. 1 |
| 4,973,938 | 11/1990 | Matsuoka | 338/116 |

*Primary Examiner*—Marvin M. Lateef

*Attorney, Agent, or Firm*—Willian Brinks Hofer Gilson & Lione

[57] ABSTRACT

An electromotive adjustable resistor, comprising an electric motor which includes a motor shaft and a gear train which has two worm gear engagements and a cylindrical gear engagement. The cylindrical gear engagement provides a distance (space) between the resistance adjusting shaft and the motor shaft along the axis of both shafts. Accordingly, the axes of the two shafts can coincide or nearly coincide without interfering with each other. This narrows the width of the electromotive adjustable resistor, and minimizes the space on the circuit board occupied by the adjustable resistor.

10 Claims, 6 Drawing Sheets

ELECTROMOTIVE ADJUSTABLE RESISTOR

BACKGROUND OF THE INVENTION

1. Field of the Invention

This invention relates to an electromotive adjustable resistor, and particularly to an adjustable resistor which is used primarily in a fixed position on the circuit board of an electronic apparatus. Resistance of the adjustable resistor is changed by rotating its resistance adjusting shaft by electromotive force or manually.

2. Discussion of Related Art

A conventional electromotive adjustable resistor 20 is illustrated in FIGS. 4, 5 and 6 which will be described herein.

As shown in FIG. 5, a gear case 2 is covered by a steel plate 1. An adjustable resistor 3, having a resistance adjusting shaft 4 extending to both sides of the adjustable resistor 3, is fixed on the steel plate 1. A driving component 6 having a circular portion 10 and a pillar portion 7 is fixed by a speed nut 5 on the resistance adjusting shaft 4 which is extending into the gear case 2. A second worm wheel 9 is assembled concentrically around the resistance adjusting shaft 4 and biased to the driving component 6 by a spring 8. The second worm wheel 9 and the driving component 6 are coupled fictionally to permit the transmission of the rotating torque between them. A pad 11 is inserted between the second worm wheel 9 and the driving component to stabilize and to reinforce the frictional coupling between them. A first worm gear 13 is placed on a motor shaft 12A of an electric motor 12.

As shown in FIG. 6, which is a sectional view taken along line A—A of FIG. 5, a gear shaft 19 is assembled rotatively around an axis C—C, having a first worm wheel 14 and a second worm gear 15 fixed on the axis C—C. The rotation of the motor shaft 12A is transmitted to the second worm wheel 9 via the first worm gear 13, the first worm wheel 14, and the second worm gear 15.

As is further shown in FIG. 5, the rotating torque of the second worm wheel 9 is transmitted to the driving component 6 through the friction coupling between them. This causes the rotation of the resistance adjusting shaft 4, so that the resistance of the adjustable resistor 3 is changed.

When supply current of the electric motor is cut off, the resistance of the adjustable resistor 3 can be manually changed by rotating the resistance adjusting shaft 4, which is extending to the counter side of the gear case 2. The driving component 6 rotates with the resistance adjusting shaft 4, but the second worm wheel 9 does not rotate with the driving component 6, since the second worm wheel 9 is prevented from rotation in both directions by the engaged second worm gear 15. This is accomplished by slipping the driving component 6 against the second worm wheel 9 through the pad 11 inserted between them.

The second worm wheel 9 and the first worm gear 13 are both arranged in the same plane in order to make the gear case 2 smaller, so that the distance between the centers of the second worm wheel 9 and the first worm gear 13 is larger than the sum of the radiuses of these components as shown in FIG. 6. This controls the width W of the conventional electromotive adjustable resistor 20, as shown in FIG. 5, making it of a comparatively large size, and prevents one from making the width narrower.

Accordingly, the conventional electromotive adjustable resistor 20 occupies a relatively large space when it is positioned on the circuit board 16. The electromotive adjustable resistor 20 is connected to the circuit board 16 by connecting an electric connecting terminal 17 of the adjustable resistor 3 and an electric connecting terminal 18 of the electric motor 12 to the circuit board 16, as shown in FIG. 4.

Thus, the electromotive adjustable resistor described above does not provide the important advantages of having an electromotive adjustable resistor constructed to be more resistant to mechanical vibration and occupying smaller space on the circuit board due to its improved construction of the gear case and the internal gear train.

SUMMARY OF THE INVENTION

One embodiment of the invention is directed to an electromotive adjustable resistor which comprises:

(a) an electric motor comprising a motor shaft;

(b) a first worm gear placed on the motor shaft of the electric motor;

(c) a first gear shaft comprising a first worm wheel and a first cylindrical gear placed on the first gear shaft, the first worm wheel engaging the first worm gear;

(d) a second gear shaft comprising a second cylindrical gear and a second worm gear placed on the second gear shaft, said second cylindrical gear engaging the first cylindrical gear;

(e) an adjustable resistor comprising a resistance adjusting shaft;

(f) a second worm wheel placed concentrically around the adjusting shaft of the adjustable resistor, said second worm wheel engaging the second worm gear; and (g) a means for transmitting a rotational torque of the second worm wheel to the resistance adjusting shaft of the adjustable resistor.

In another embodiment of the invention, the means for transmitting the rotational torque comprises a frictional means.

Another embodiment of the invention is directed to an electromotive adjustable resistor comprising:

(a) an electric motor which comprises a motor shaft;

(b) a first worm gear placed on the motor shaft of the electric motor;

(c) a first gear shaft comprising a first worm wheel and a first cylindrical gear placed on the first gear shaft, said first worm wheel engaging the first worm gear;

(d) a second gear shaft comprising a second cylindrical gear and a second worm gear placed on the second gear shaft, said second cylindrical gear engaging the first cylindrical gear;

(e) an adjustable resistor comprising a resistance adjusting shaft, a driving component placed on the resistance adjusting shaft of the adjustable resistor;

(f) a second worm wheel placed concentrically around the resistance adjusting shaft of the adjustable resistor, said second worm wheel engaging the second worm gear.

In this embodiment of the invention, the second worm wheel and the driving component are coupled fictionally to enable the transmission of a rotating torque between the second worm wheel and the driving component.

In all the embodiments of the invention, the means for transmitting the rotational torque of the second worm wheel to the resistance adjusting shaft and the means for fictionally coupling of the second worm wheel to the driving component may also comprise any suitable device, such as a spring. Thus, the gear train of the electromotive adjustable resistor of the present invention comprises two worm gear engagements and a cylindrical gear engagement.

The electromotive adjustable resistor of the present invention provides important advantages. The cylindrical gear engagement provides space between the two worm gear engagements, thus, providing space between the resistance adjusting shaft and the motor shaft along the axes of the two shafts.

Accordingly, the axis of the two shafts can coincide or nearly coincide with each other, depending on the design, without interfering with each other. This narrows the width W of the electromotive adjustable resistor, and reduces the space occupied by the electromotive adjustable resistor on the circuit board when compared with the conventional type of an adjustable resistor in which the axis of the two shafts usually cannot coincide and must be laterally spaced with respect to each other. Furthermore, the improved construction also lowers the center of gravity closer to the circuit board.

Thus, the electromotive adjustable resistor of the present invention has a relatively small size and is more resistant mechanical vibration, as compared to the conventional electromotive adjustable resistors, such as those illustrated in FIGS. 4–6.

DESCRIPTION OF THE PREFERRED EMBODIMENTS

Figure 1:
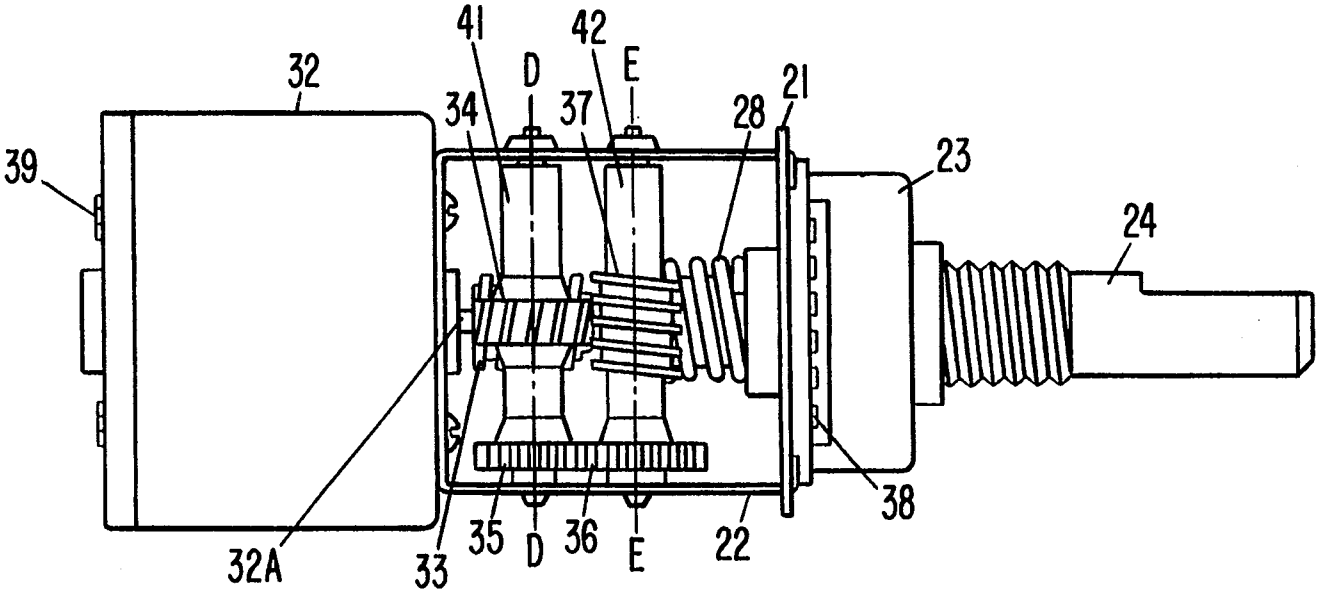
FIG. 1 is a side view of the electromotive adjustable resistor of the present invention.
Figure 2:
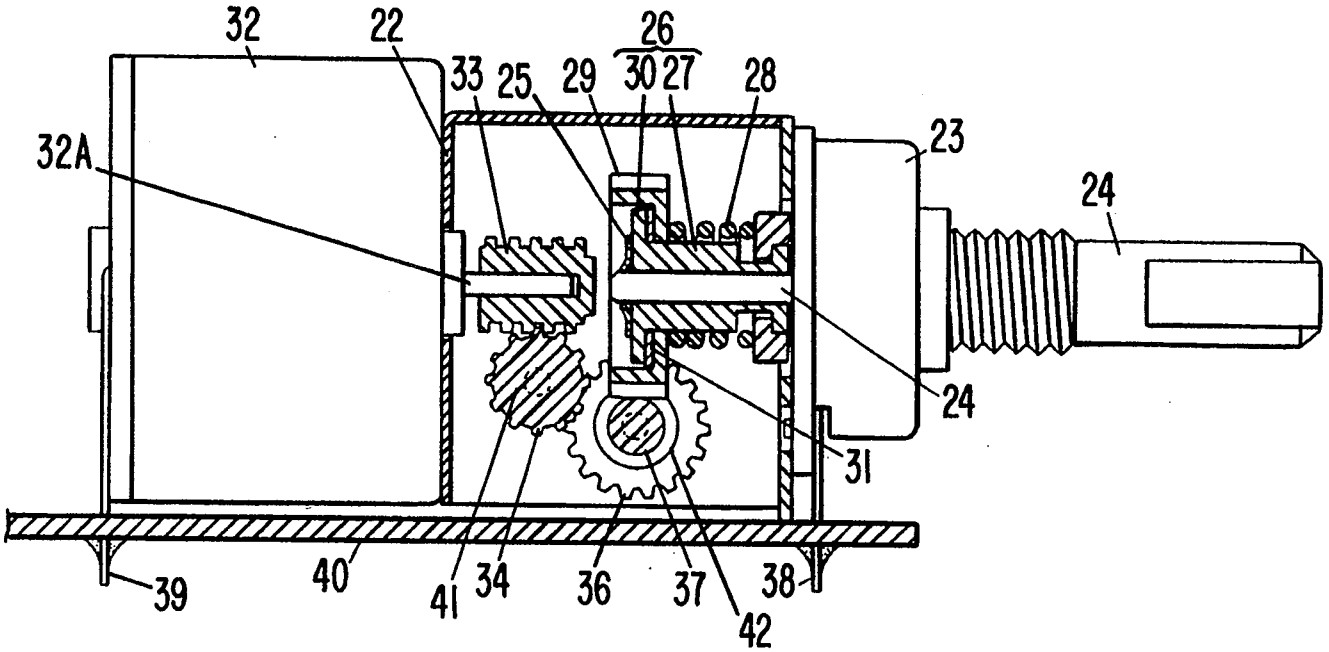
FIG. 2 is a partial sectional view of the electromotive adjustable resistor of the present invention, taken along the line B—B of FIG. 1, which is connected to the circuit board.

An electromotive adjustable resistor 44 of the present invention will now be described with reference to FIGS. 1, 2, and 3. As shown in FIG. 1, the electromotive adjustable resistor 44 comprises a gear case 22 covered with a steel plate 21. As shown in FIG. 2, an adjustable resistor 23 having a resistance adjusting shaft 24 extending from both sides of the adjustable resistor 23, is placed on the steel plate 21. A driving component 26 having a circular portion 30 and a pillar portion 27 is attached by a speed nut 25 to the resistance adjusting shaft 24 which is extending into the gear case 22. A second worm wheel 29 is assembled concentrically around the resistance adjusting shaft 24 and biased against the driving component 26 by a spring 28 (which is preferably a coil spring). The second worm wheel 29 and the driving component 26 are coupled fictionally so that the transmission of the rotating torque between them is possible. A pad 31 is inserted between the second worm wheel 29 and the driving component 26 to stabilize and to enhance the frictional coupling between them. A first worm gear 33 is fixed on a motor shaft 32A of an electric motor 32.

As shown in FIGS. 1 and 2, a first gear shaft 41 is assembled in the gear case 22 rotatively around the axis D—D. The first gear shaft 41 has a first worm wheel 34, which engages the first worm gear 33. The first gear shaft 41 also has a first cylindrical gear 35 fixed on it. A second gear shaft 42 is assembled in the gear case 22 rotatively around the axis E—E. The second gear shaft 42 has a second cylindrical gear 36, which engages with the first cylindrical gear 35. The second gear shaft 42 also has a second worm gear 37 placed on the second gear shaft 42, which engages with the second worm wheel 29

Accordingly, the gear train of the electromotive adjustable resistor 44 of the present invention comprises two worm gear engagements and a cylindrical gear engagement.

FIG. 2 illustrates the electromotive adjustable resistor 44 of the invention connected to a circuit board 40. As shown in FIG. 2, the cylindrical gear engagement provides space between the two worm gear engagements. Thus, the cylindrical gear engagement provides space between the resistance adjusting shaft 24 and the motor shaft 32A along the axes of the two shafts D—D, E—E.

Figure 5:
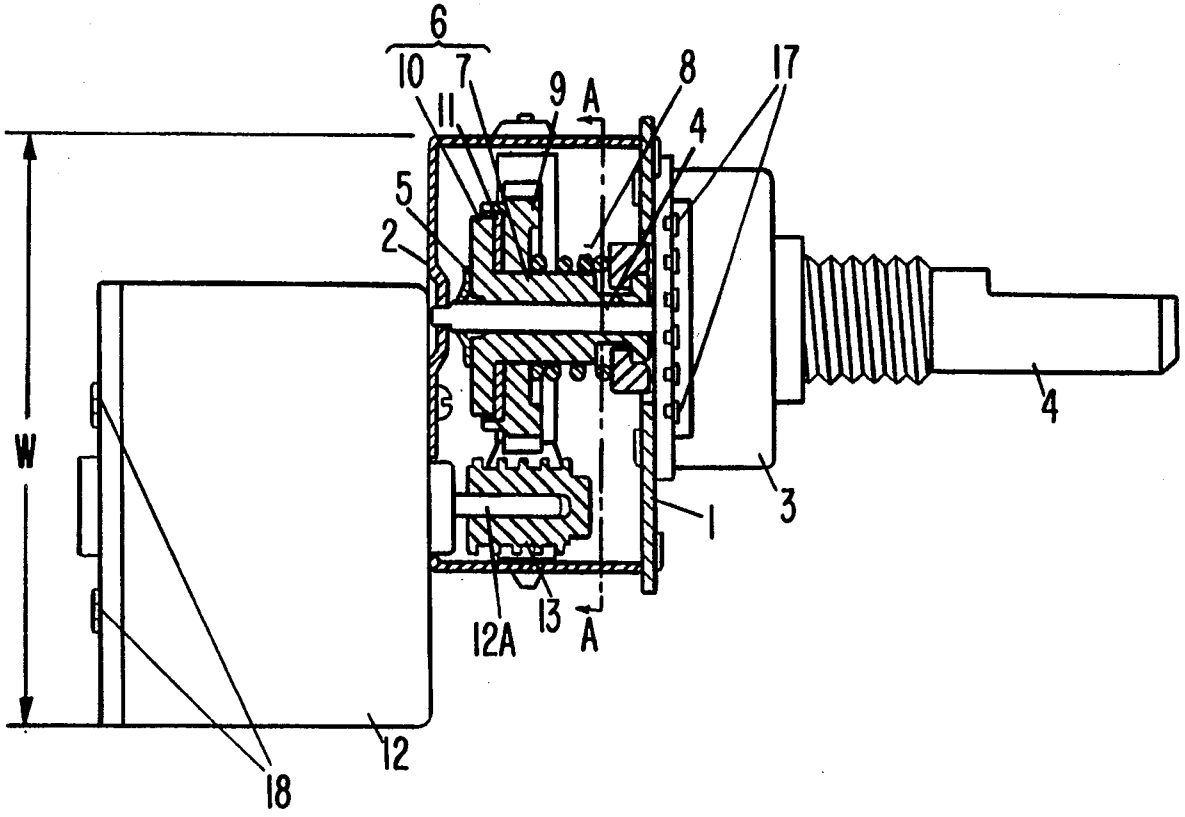
FIG. 5 shows a partial sectional view of the conventional electromotive adjustable resistor.

Therefore, the axes of these two shafts D—D, E—E can coincide or nearly coincide with each other, depending on the design criteria, without interfering with each other. This makes the width W of the electromotive adjustable resistor smaller, and decreases the space occupied by the adjustable resistor 23 on the circuit board 40, as compared with the conventional type of the electromotive adjustable resistor 20 in which the axis of the resistance adjusting shaft 4 must be spaced laterally from the motor shaft, thereby increasing the width W (see FIG. 5).

Of course, if desirable or necessary, it is also possible to place the motor shaft 32A and the resistance adjusting shaft 24 of the electromotive adjustable resistor 44 of the invention in such a manner so that their axes do not coincide with each other. For example, the motor shaft 32A and the resistance adjusting shaft 24 could be placed so that their axes are laterally offset with respect to each other.

The rotation of the motor shaft 32A transmits the energy (also referred to herein as "motion or rotation") to the second worm wheel 29 via the first worm gear 33, the first worm wheel 34, the first cylindrical gear 35, the second cylindrical gear 36, and the second worm gear 37. The rotating torque of the second worm wheel 29 transmits the energy (motion or rotation) to the driving component 26 through the friction coupling between the second worm wheel 29 and the driving component 26 and rotates the resistance adjusting shaft 24, so that the resistance of the adjustable resistor 23 can be varied.

When supply current of the electric motor is cut off, the resistance of the adjustable resistor 23 can be manually changed by rotating the resistance adjusting shaft 24, which is extending to the counter side of the gear case 22. The driving component 26 rotates with the resistance adjusting shaft 24, but the second worm wheel 29 does not rotate with the driving component 26, since the second worm wheel 29 is prevented from rotation in both directions by the engaged second worm gear 37.

Accordingly, this is accomplished by slipping the driving component 26 against the second worm wheel 29 through the pad 31 inserted between them. The resistance adjusting shaft 24 can then be rotated manually.

Figure 3:
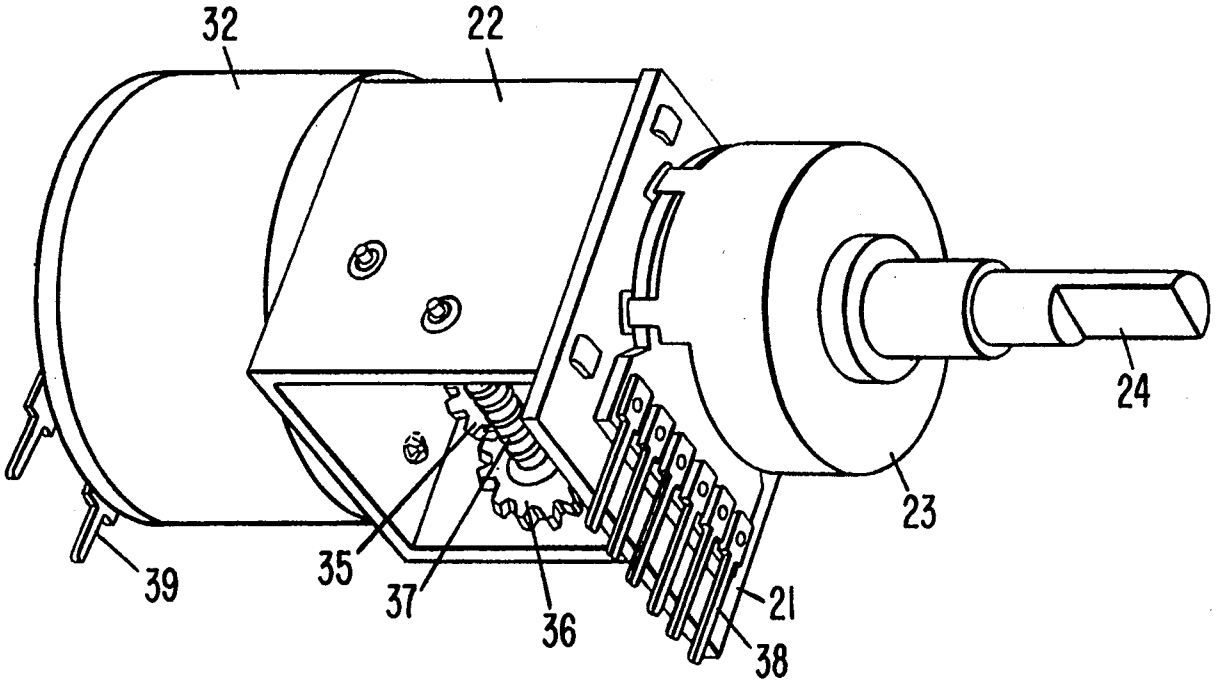
FIG. 3 is a perspective view of the electromotive adjustable resistor of the present invention.

As shown in FIGS. 2 and 3, a first electric connecting terminal 38 at the adjustable resistor 23 extends substantially at a right angle to the axis of the resistance adjusting shaft 24 of the adjustable resistor 23, and a second electric connecting terminal 39 of the motor 32 extends substantially at a right angle to the axis of the motor shaft 32A. Both electric connecting terminals 38 and 39 extend substantially in the same direction for the convenience of connecting them to the circuit board 40 The term "substantially at a right angle, " as used herein means that the respective components are placed at an angle of 90°± about 15% with respect to each other. Preferably, such components are placed at an angle of 90° with respect to each other.

The first gear shaft 41 and the second electric connecting terminal 39 both extend substantially in the game direction with respect to the axis of the motor shaft 32A, and the second gear shaft 42 and the first electric connecting terminal 38 both extend substantially in the same direction with respect to the axis of the resistance adjusting shaft 24 of the adjustable resistor 23.

According to the present invention, a wide range of variations, changes and modifications can be made to the exemplary embodiments described above. For example, the exterior of the electromotive adjustable resistor 44 can be made of any suitable material, such as metal (aluminum or steel), wood or any one of plastic materials available on the market or, any combination of the above materials, such as metal and plastic.

In yet another variation, the spring 28, illustrated in the exemplary embodiment of FIGS. 1–3 described above, may be replaced by a suitable number of leaf-spring elements, which would perform the same function as the coil spring 28.

In a further variation, the electric connecting terminal 38 of the adjustable resistor 23 and the electric connecting terminal 39 of the electric motor 32 may be placed at any suitable location on the electromotive adjustable resistor 44 and at any suitable angle with respect to the resistance adjusting shaft 24 or the motor shaft 32A, respectively.

Figure 4:
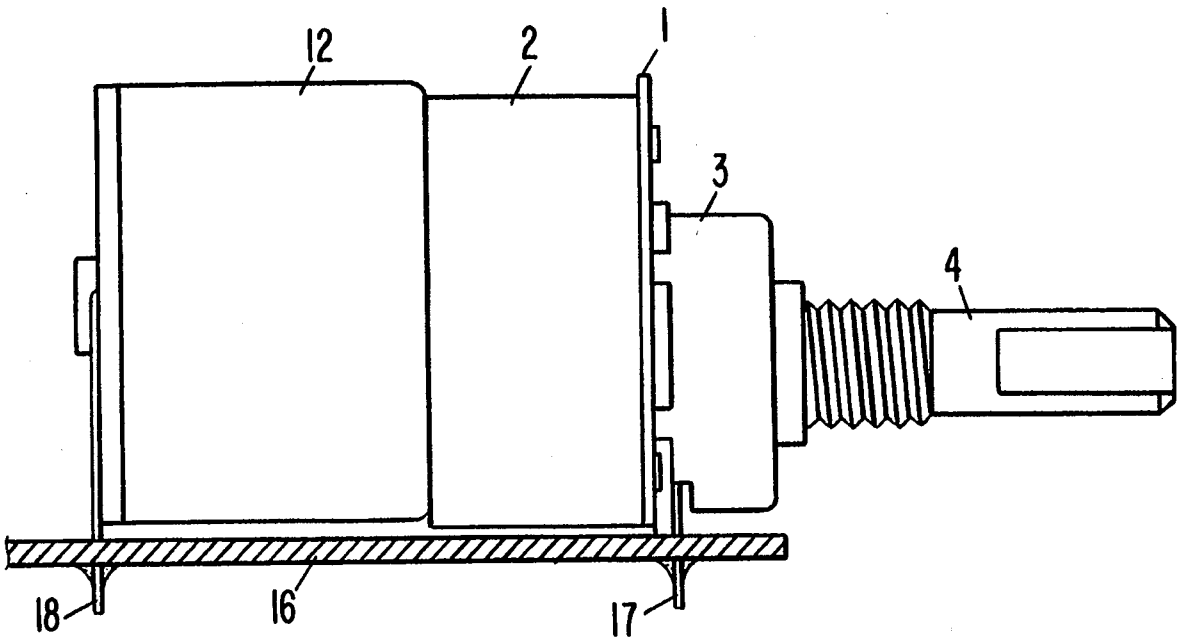
FIG. 4 shows a conventional electromotive adjustable resistor which is connected to the circuit board.
Figure 6:
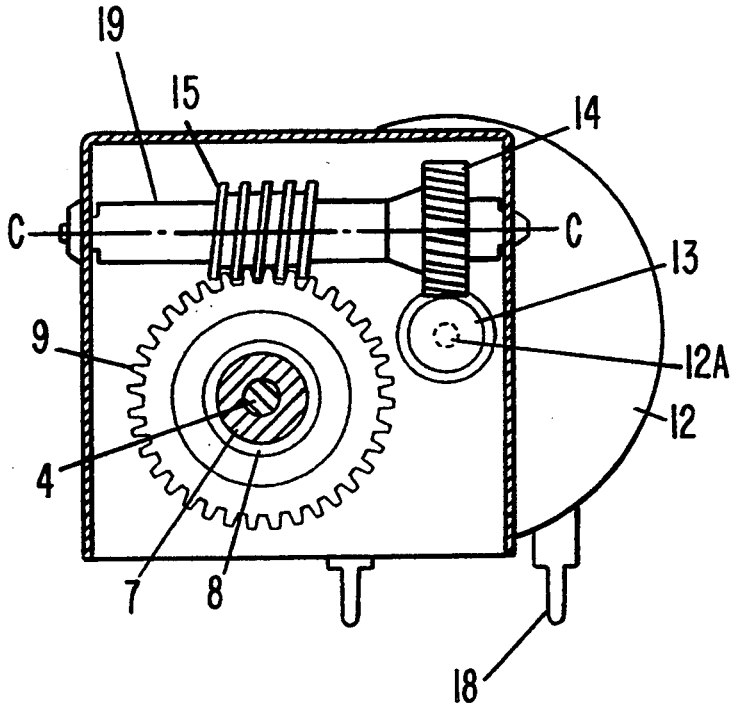
FIG. 6 is a sectional view along the line A—A of FIG. 5, showing the construction inside the gear case of the conventional electromotive adjustable resistor.

The embodiments described above provide a number of significant advantages. The improved construction of the gear case 22 and the internal gear train of the electromotive adjustable resistor 44 of the invention, described above, narrow the width W, and therefore lower the height of the electromotive adjustable resistor 44. The improved construction also lowers the center of gravity of the adjustable resistor, thereby bringing that center of gravity closer to the circuit board. Thus, the electromotive adjustable resistor of the present invention has a relatively small size and is more resistant to mechanical vibration, as compared to the conventional electromotive adjustable resistors, such as those illustrated in FIGS. 4–6.

Of course, the invention may be embodied in other specific embodiments without departing from the spirit or essential characteristics thereof. The foregoing description of the preferred embodiments is therefore to be considered as illustrative rather than restrictive, and it is to be understood that including all equivalents thereof the scope of the invention is defined by the appended claims, rather than the foregoing description.

We claim:

1. An electromotive adjustable resistor comprising:

(a) an electric motor comprising a motor shaft;

(b) a first worm gear placed on the motor shaft of the electric motor;

(c) a first gear shaft comprising a first worm wheel and a first cylindrical gear placed on the first gear shaft, said first worm wheel engaging the first worm gear;

(d) a second gear shaft comprising a second cylindrical gear and a second worm gear placed on the second gear shaft, said second cylindrical gear engaging the first cylindrical gear;

(e) an adjustable resistor comprising a resistance adjusting shaft;

(f) a second worm wheel placed concentrically around the resistance adjusting shaft of the adjustable resistor, said second worm wheel engaging the second worm gear; and (g) a means for transmitting a rotating torque of the second worm wheel to the resistance adjusting shaft of the adjustable resistor.

2. An electromotive adjustable resistor comprising:

(a) an electric motor comprising a motor shaft;

(b) a first worm gear placed on the motor shaft of the electric motor;

(c) a first gear shaft comprising a first worm wheel and a first cylindrical gear placed on the first gear shaft, said first worm wheel engaging the first worm gear;

(d) a second gear shaft comprising a second cylindrical gear and a second worm gear placed on the second gear shaft, said second cylindrical gear engaging the first cylindrical gear;

(e) an adjustable resistor comprising a resistance adjusting shaft;

(f) a driving component placed on the resistance adjusting shaft of the adjustable resistor;

(g) a second worm wheel placed concentrically around the resistance adjusting shaft of the adjustable resistor, said second worm wheel engaging the second worm gear;

the second worm wheel and the driving component being coupled fictionally, to enable the transmission of a rotating torque between the second worm wheel and the driving component.

3. An electromotive adjustable resistor of claim 2, comprising a means for reinforcing the frictional coupling between the second worm wheel and the driving component.

4. An electromotive adjustable resistor of claim 3 wherein said means for reinforcing the frictional coupling comprises a spring.

5. An electromotive adjustable resistor of claim 4 wherein the spring is assembled concentrically around the resistance adjusting shaft, the spring biasing the second worm wheel against the driving component.

6. An electromotive adjustable resistor of claim 1, wherein (i) an electric connecting terminal of the electric motor extends substantially at a right angle to the axis of the motor shaft of the electric motor;

(ii) an electric connecting terminal of the adjustable resistor extends substantially at a right angle to the axis of the resistance adjusting shaft of the adjustable resistor;

(iii) and, the electric connecting terminal of the electric motor and the electric connecting terminal of the adjustable resistor extend in substantially the save direction.

7. An electromotive adjustable resistor of claim 6, wherein both, the first gear shaft and the electric connecting terminal of the electric motor, extend in substantially the same direction with respect to the axis of the motor shaft of the electric motor, and the second gear shaft and the electric connecting terminal of the adjustable resistor both extend in substantially the same direction with respect to the axis of the resistance adjusting shaft of the adjustable resistor.

8. An electromotive adjustable resistor of claim 2, wherein (i) an electric connecting terminal of the electric motor extends substantially at a right angle to the axis of the motor shaft of the electric motor;

(ii) an electric connecting terminal of the adjustable resistor extends substantially at a right angle to the axis of the resistance adjusting shaft of the adjustable resistor;

(iii) and, the electric connecting terminal of the electric motor and the electric connecting terminal of the adjustable resistor extend in substantially the same direction.

9. An electromotive adjustable resistor of claim 8, wherein:

(i) both, the first gear shaft and the electric connecting terminal of the electric motor extend in substantially the same direction with respect to the axis of the motor shaft of the electric motor; and (ii) the second gear shaft and the electric connecting terminal of the adjustable resistor both extend in substantially the same direction with respect to the axis of the resistance adjusting shaft of the adjustable resistor.

10. An electromotive resistor of claim 1 wherein the means for transmitting the rotating torque is a friction means.

* * * * *